US007654116B1

(12) United States Patent
Trelease

(10) Patent No.: US 7,654,116 B1
(45) Date of Patent: Feb. 2, 2010

(54) ARCHITECTURAL SCARF

(76) Inventor: Anne Trelease, 1222 S. Westgate Ave., #102, Los Angeles, CA (US) 90025

( * ) Notice: Subject to any disclaimer, the term of this patent is extended or adjusted under 35 U.S.C. 154(b) by 0 days.

(21) Appl. No.: 12/334,079

(22) Filed: Dec. 12, 2008

(51) Int. Cl.
*D04B 9/42* (2006.01)

(52) U.S. Cl. ..... 66/176

(58) Field of Classification Search ..... 66/169 R, 66/170, 171, 172 R, 176, 175, 195, 200; 2/144–148
See application file for complete search history.

(56) References Cited

U.S. PATENT DOCUMENTS

| | | | | | |
|---|---|---|---|---|---|
| D8,034 | S | * | 1/1875 | Prindle | D2/501 |
| 445,137 | A | | 1/1891 | Erskine | |
| D39,347 | S | * | 6/1908 | Mead | D2/500 |
| D39,610 | S | * | 10/1908 | Mead | D2/500 |
| D39,611 | S | * | 10/1908 | Mead | D2/500 |
| D39,612 | S | * | 10/1908 | Mead | D2/500 |
| D39,732 | S | * | 12/1908 | Mead | D2/500 |
| D41,088 | S | * | 1/1911 | Sampliner | D2/500 |
| D41,519 | S | * | 6/1911 | Way | D2/500 |
| D41,905 | S | * | 11/1911 | Meyers | D2/500 |
| 1,105,407 | A | * | 7/1914 | Curtis | 66/172 R |
| 1,597,410 | A | * | 8/1926 | Hinchliff | 66/171 |
| 1,666,819 | A | * | 4/1928 | Goetze | 66/171 |
| D76,481 | S | * | 10/1928 | Hoeflich | D11/120 |
| 1,787,043 | A | * | 12/1930 | Karger | 2/195.8 |
| 1,970,495 | A | * | 8/1934 | Deich | 2/91 |
| 2,032,448 | A | * | 3/1936 | Staff | 2/207 |
| D99,849 | S | * | 6/1936 | Applebaum | D2/602 |
| 2,083,616 | A | * | 6/1937 | Rosenberg | 2/203 |
| 2,112,774 | A | | 3/1938 | Thorman | |
| D118,335 | S | * | 12/1939 | Freudenberg | D2/603 |
| 2,494,250 | A | * | 1/1950 | Loven | 2/91 |
| D166,915 | S | * | 6/1952 | Iwaniec | D2/501 |
| 2,735,283 | A | * | 2/1956 | Schuessler | 2/202 |
| 2,858,685 | A | | 11/1958 | Sommers | |
| 3,184,758 | A | * | 5/1965 | Hirsch | 2/209 |
| 3,286,278 | A | * | 11/1966 | O'Connor | 2/116 |
| 3,807,200 | A | | 4/1974 | Liwski | |
| 3,898,699 | A | * | 8/1975 | Zientara et al. | 2/175.1 |
| 4,038,840 | A | * | 8/1977 | Castello | 66/170 |
| 4,942,627 | A | * | 7/1990 | Copprue | 2/207 |
| 5,255,538 | A | | 10/1993 | Day | |
| 5,720,049 | A | | 2/1998 | Clutton | |
| 6,167,732 | B1 | * | 1/2001 | Friedman | 66/173 |
| 6,176,105 | B1 | | 1/2001 | Hung Chan et al. | |

(Continued)

OTHER PUBLICATIONS castingpurls.com/blog/2007_01_01_archive.html.

(Continued)

*Primary Examiner*—Danny Worrell
(74) *Attorney, Agent, or Firm*—Marc E. Hankin; Kevin E. Schraven; Hankin Patent Law, APC

(57) ABSTRACT

Various embodiments of this invention disclose a scarf with a knit tension differential between opposing sides along the length of the scarf that produces the effect of a scarf that takes and holds certain specific architectural shapes when it is worn by a user. The scarf of the present invention preferably has a three dimensional, hyperbolic shape that takes and holds certain architectural shapes when wrapped in different ways around the wearer.

7 Claims, 6 Drawing Sheets

U.S. PATENT DOCUMENTS

| | | | | |
|---|---|---|---|---|
| 6,227,011 | B1 * | 5/2001 | Cortinovis | 66/171 |
| RE39,095 | E * | 5/2006 | Friedman | 66/173 |
| 7,225,645 | B1 | 6/2007 | Hennenberg | |
| D595,479 | S * | 7/2009 | Trelease | D2/500 |
| 2006/0185400 | A1 * | 8/2006 | Zheng | 66/170 |

OTHER PUBLICATIONS http://www.hatattack.com/Merchant2/merchant.mvc?Screen=PROD&Product_Code=MAS690&Category_Code=ACC&Product_Count=3.

http://featherandfan.wordpress.com/category/tips-and-techniques/.

http://www.hatattack.com/Merchant2/merchant.mvc?Screen=PROD&Store_Code=HA&Product_Code=MAS660.

http://blog.craftzine.com/archive/crochet/18.html.

www.wingedsheep.com/blog/2006/04.html.

http://curlywhirlies.blogspot.com/2006/06/slithering-snakes.html.

http://curlywhirlies.blogspot.com/2006/02/another-curly-wurly.html.

http://www.knittingdaily.com/freepatterns/crochet/223-1.html.

* cited by examiner

ARCHITECTURAL SCARF

BACKGROUND OF THE INVENTION

This invention generally relates to an article of clothing. Specifically, it pertains to a scarf or scarf-like article of clothing designed to take and hold certain defined shapes when worn around the neck of the wearer.

Scarves are an important accessory to any wardrobe because they offer warmth, versatility, and a way to accent or complete a wardrobe. Scarves are typically flat, rectangular, straight edged, and are made from a uniformly woven or knitted cloth material. Frequently, these straight edge scarves are woven to be precisely straight, to have even knitting, and to have an even knit tension differential. Because of this even knit tension differential, most scarves are limp and fail to hold the shape that the wearer places the scar in around the neck. As such, the wearer is forced to continually adjust the scarf so that it once again takes the shape desired by the user.

Although there are mechanisms external to the stitch types or knit types of the scarf, such as plastic inserts or elastic bands, which can be used to create a scarf that holds its shape, there is no scarf available that holds its shape solely from knit tension. A scarf with knit tension differential between opposing sides along the length of a scarf produces the effect of a scarf that takes and holds certain desired shapes when it is worn by a user. To date, no such scarf has been commercially available on the market.

A typical scarf is disclosed by U.S. Pat. No. 1,666,819, issued to Goetze. Goetze discloses a scarf that is rectangular, flat, and has two types of knit stitching, a tight stitch on the outer edges and a loose stitch on the inside. However, the knit stitching of the scarves of Goetze does not create a knit tension differential between opposing sides along the length of the scarf, and it does not produce the effect of a scarf that takes and holds a desired specific shape when it is worn by a user. Indeed, the dual knit stitching of the Goetze scarf is wholly for an ornamentally visual effect and serves no actual structural utilitarian purpose.

There are scarves commercially available, such as curly whirlies, that are stitched or knitted so that the scarf takes on a circular shape. However, a curly whirly is specifically knitted to have a circular-corkscrew shape, and the curvature of a curly whirly is usually so extreme that it gives the scarf a wavy or warped look. Additionally, the curly whirly does not have a knit tension differential between opposing sides along the length of the scarf, and it does not produce the effect of a scarf that holds a shape when worn by a user. Indeed, a curly whirly is designed to be floppy and wavy, rather than architecturally structured and shape retaining.

Thus, there remains a long felt need in the art for a scarf with knit tension differential between opposing sides along the length of the scarf that produces the effect of a scarf that takes and holds certain specific desired shapes when it is worn by a user.

BRIEF SUMMARY OF THE INVENTION

To minimize the limitations in the prior art, and to minimize other limitations that will become apparent upon reading and understanding the present specification, the present invention discloses a scarf with a knit tension differential between opposing sides along the length of the scarf that produces the effect of a scarf that takes and holds a specific desired shape when it is worn by a user. The scarf of the present invention preferably has a three dimensional, hyperbolic shape that takes and holds a specific architectural shape when wrapped in different ways around the wearer.

One embodiment of this invention is a scarf, comprising: a hyperbolic scarf body. The hyperbolic scarf body has an inner edge and an outer edge. The inner edge and the outer edge are on opposing sides along a length of the hyperbolic scarf body. The inner edge is knitted from a narrow stitch and said outer edge is knitted from a wide stitch, and the narrow stitch and the wide stitch create a differential in a knit tension between the inner edge and the outer edge along the length of the hyperbolic scarf body. The inner edge and the outer edge meet at a transition, wherein the transition runs along the length of the hyperbolic scarf body. The differential in the knit tension causes said scarf to have a natural hyperbolic curve with the inner edge smaller than and concentrically disposed within the outer edge. The differential in the knit tension causes the scarf to take and maintain a specific structural shape when draped around a neck of a user. The hyperbolic scarf body forms a shape of a letter C when laid out flat on a surface. The hyperbolic scarf has a middle section and two end sections. The middle section is a different color or pattern than the two end sections, and the two end sections are the same color or pattern.

Another embodiment of the invention is a method of tying a scarf comprising the following steps: 1) providing a hyperbolic scarf body with an inner edge and an outer edge, wherein the inner edge and the outer edge are on opposing sides along a length of the hyperbolic scarf body, wherein the inner edge and the outer edge meet at a transition, wherein the transition runs along the length of the hyperbolic scarf body, wherein the inner edge and the outer edge have different stitching that creates a differential in a knit tension between the inner edge and the outer edge along the length of the hyperbolic scarf body, wherein the differential in the knit tension causes the scarf to have a natural hyperbolic curve with the inner edge smaller than and concentrically disposed within the outer edge, and wherein the differential in the knit tension causes the scarf to maintain a structural shape when draped or wrapped around the neck of wearer; 2) providing a hyperbolic scarf body with a middle section and two end sections; and 3) draping the scarf around the neck of the wearer, wherein the middle section frames a back of the neck and the two end sections rest on a plurality of shoulders of the wearer and hang in a front of a torso of the wearer, wherein the inner edge of the middle section is below the outer edge of the middle section, wherein the inner edge of the two end sections hang distally from the front of the torso of the wearer, wherein the outer edge of the two end sections are proximal to the inner edge of the two end sections, and wherein the middle section and the two end sections remain in place and maintain the structural position chosen by the wearer. The method further comprises the steps of: crossing the two end sections such that one of the two end sections is in a front of the other of the two end sections; wrapping one of the two end sections around an opposite side of the neck of the wearer, such that the wrapped end section hangs down a back of the wearer; and wrapping a second of the two end sections around the opposite side of the neck of the wearer, such that both the wrapped end sections hang down a back of the wearer.

An object of the present invention is to provide a scarf that will overcome the deficiencies of the prior art.

Another object of the present invention is to provide a scarf frames the face and holds an interesting sculptural shape and one of several desired architectural structures, shapes, and positions.

Another object of the present invention is to provide a scarf with a unique and subtly appealing design that frames face, highlighting the neck, jaw, collarbones and base of the throat.

Another object of the present invention is to provide an inexpensive, fashionable, well made, long lasting, and durable scarf.

Another object of this invention is to provide a scarf that can be wrapped around the neck of a user in many different ways to form new and interesting structural looks. The scarf is adjustable and customizable in numerous ways.

Another object of this invention is to provide a scarf that has a natural hyperbolic or hyperboloid curve when laid out on a flat surface.

Other features and advantages are inherent in the scarf claimed and disclosed will become apparent to those skilled in the art from the following detailed description and its accompanying drawings.

DETAILED DESCRIPTIONS OF THE DRAWINGS

In the following detailed description of the preferred embodiment, reference is made to the accompanying drawings that form a part hereof, and in which is shown, by way of illustration, a specific embodiment in which the invention may be practiced. It is to be understood that other embodiments may be utilized and structural changes may be made without departing from the scope of the present invention.

In the following detailed description of various embodiments of the invention, numerous specific details are set forth in order to provide a thorough understanding of various aspects of one or more embodiments of the invention. However, one or more embodiments of the invention may be practiced without these specific details. In other instances, well-known methods, procedures, and/or components have not been described in detail so as not to unnecessarily obscure aspects of embodiments of the invention.

Figure 1:
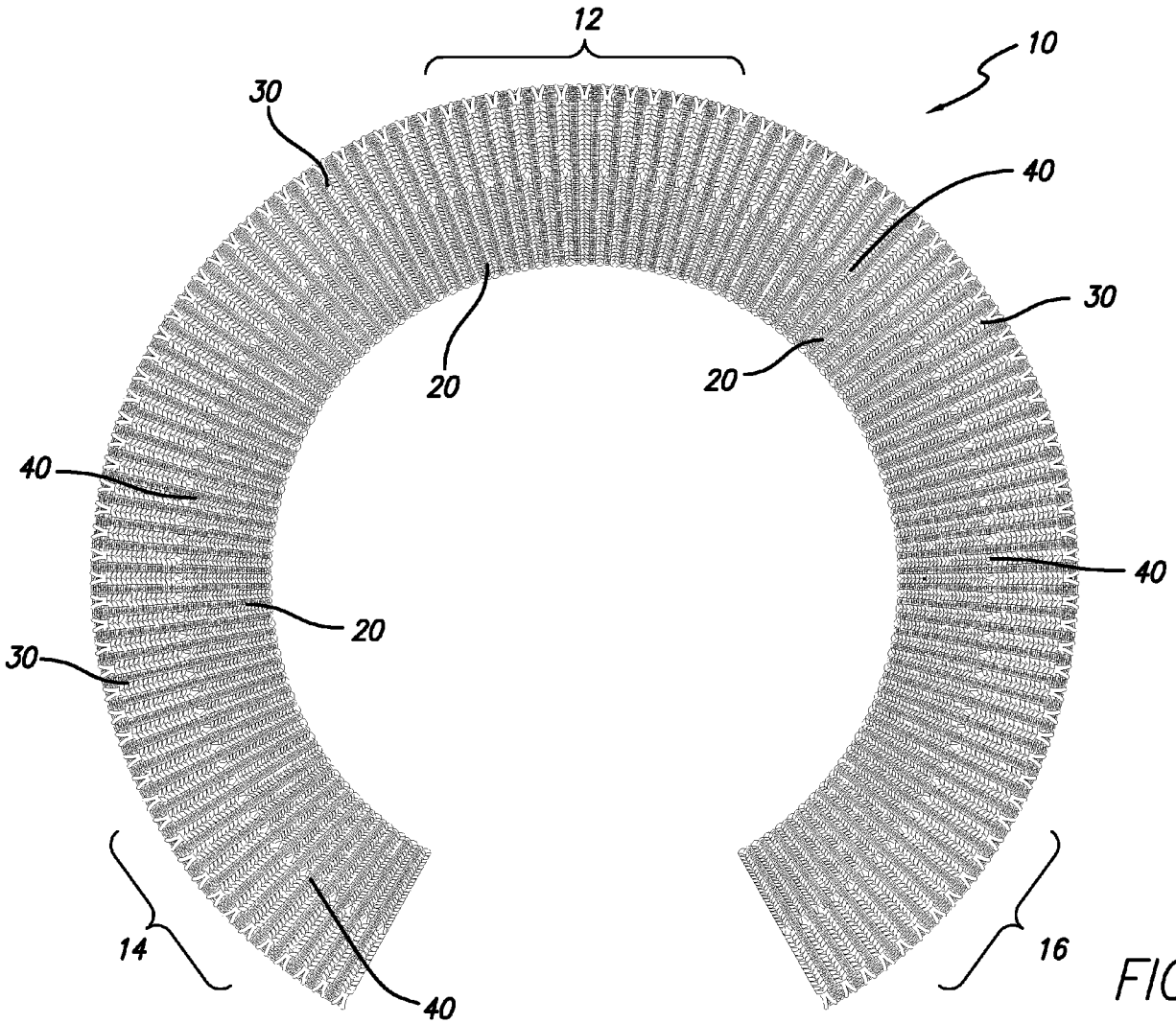
FIG. 1 is an illustration of a top plan view of one embodiment of the scarf.

FIG. 1 is an illustration of a top plan view of one embodiment of the scarf. As shown in FIG. 1, scarf 10 preferably has a middle section 12, two end sections 14 and 16, an inner edge 20, an outer edge 30, and a transition 40. FIG. 1 shows how scarf 10 has a hyperbolic curve. This curve is a natural result of a knit tension differential that is caused by the inner edge 20 and the outer edge 30 having two different types of knit stitches. Preferably inner edge 20 is made with a narrow stitch, such as a regular 1×1 rib knit stitch and outer edge 30 is made with a wide stitch, such as a Fisherman's/English/Shaker rib knit stitch. As shown in FIG. 1, these different stitches preferably transition along the entire length of scarf 10. This transition is shown in FIG. 1 as transition 40. Scarf 10 may be made with any stitching, as long as a stitching creates a knit tension and this knit tension causes the scarf to hold a structural shape when draped or wrapped around the user. A wide stitch, such as a Fisherman's/English/Shaker rib knit stitch is bulkier and more voluminous than a narrow stitch and uses more yarn per stitch. A narrow stitch is tighter and denser than a wide stitch.

Preferably scarf 10 is knitted, stitched, or crocheted, and scarf 10 may be made by hand or machine. Preferably, scarf 10 is made from animal fibers, such as silk, or the hair from animals such as, sheep (wool), goat (angora, or cashmere goat), rabbit (angora), llama, alpaca, dog, camel, yak, and musk-ox (qiviut). However, scarf 10 may be made from any material that can be knitted, including, but not limited to: ribbons; metal wire; exotic filaments; fiberglass; plant based yarn fibers, made from such plants as cotton, flax (for linen), bamboo, ramie, hemp, jute, nettle, raffia, yucca, coconut husk, banana trees, soy and corn; intermediate fibers such as rayon and acetate fibers, which are produced from cellulose mainly derived from trees; and synthetic fibers, such as, acrylics, polyesters, polyethylene terephthalate, synthetic biopolymers, nylon and other polyamides, and olefins such as polypropylene.

As shown in FIG. 1, when scarf 10 is laid out flat, on a flat surface, the natural curvature of the scarf roughly forms the shape of the letter "C". This shape is preferred because it allows a high degree of versatility in wrapping the scarf around a user in a manner that the scarf will take and hold a specific desired shape.

Figure 2:
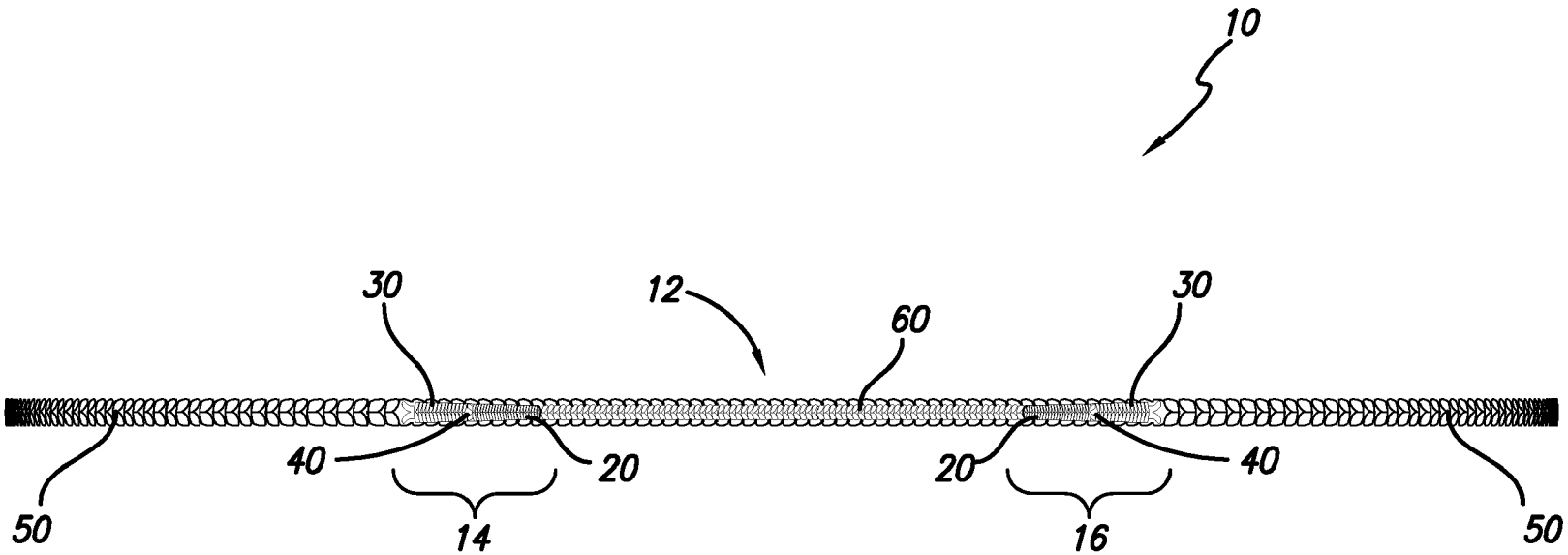
FIG. 2 is an illustration of a side plan view of one embodiment of the scarf.

FIG. 2 is an illustration of a side plan view of one embodiment of the scarf. As shown in FIG. 2, scarf 10 has, two end sections 14 and 16, middle section 12, inner edge 20, outer edge 30, transition 40, side of outer edge 50, and side of inner edge 60. FIG. 2 shows how the knit stitching of scarf 10 creates a visible thickness and gives scarf 10 a three dimensional structure. The combination of the three dimensional structure and the hyperbolic shape allow scarf 10 to hold a shape when wrapped, in different ways, around a wearer. In this way scarf 10 is adjustable and customizable in numerous ways.

Figure 3:
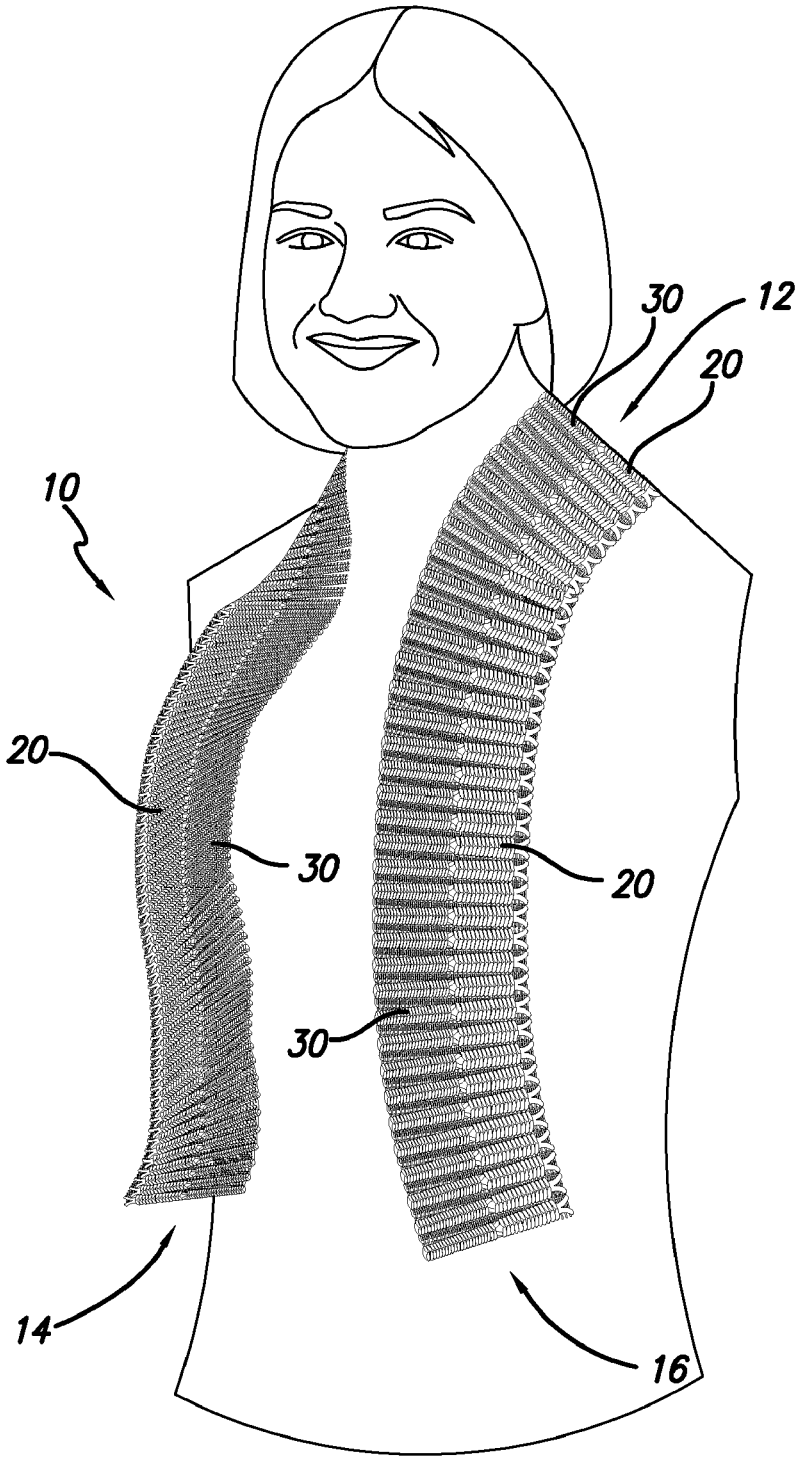
FIG. 3 is an illustration of a placement and structure one embodiment of the scarf takes and holds as a result of an application of one method of placing or tying the scarf around the wearer.

FIG. 3 is an illustration of a method by which one embodiment of the scarf may be placed or tied around the wearer. As shown in FIG. 3, scarf 10 is draped around a wearer in an open manner. FIG. 3 shows scarf 10 with the middle section 12 around the neck of the wearer and the two end sections 14 and 16 in front of the wearer. The outer edge 30 is on top around the neck, and on the inside at the two end sections 14 and 16. The inner edge 20 is the on bottom around the neck, and on the outside at the two end sections 14 and 16.

Figure 4:
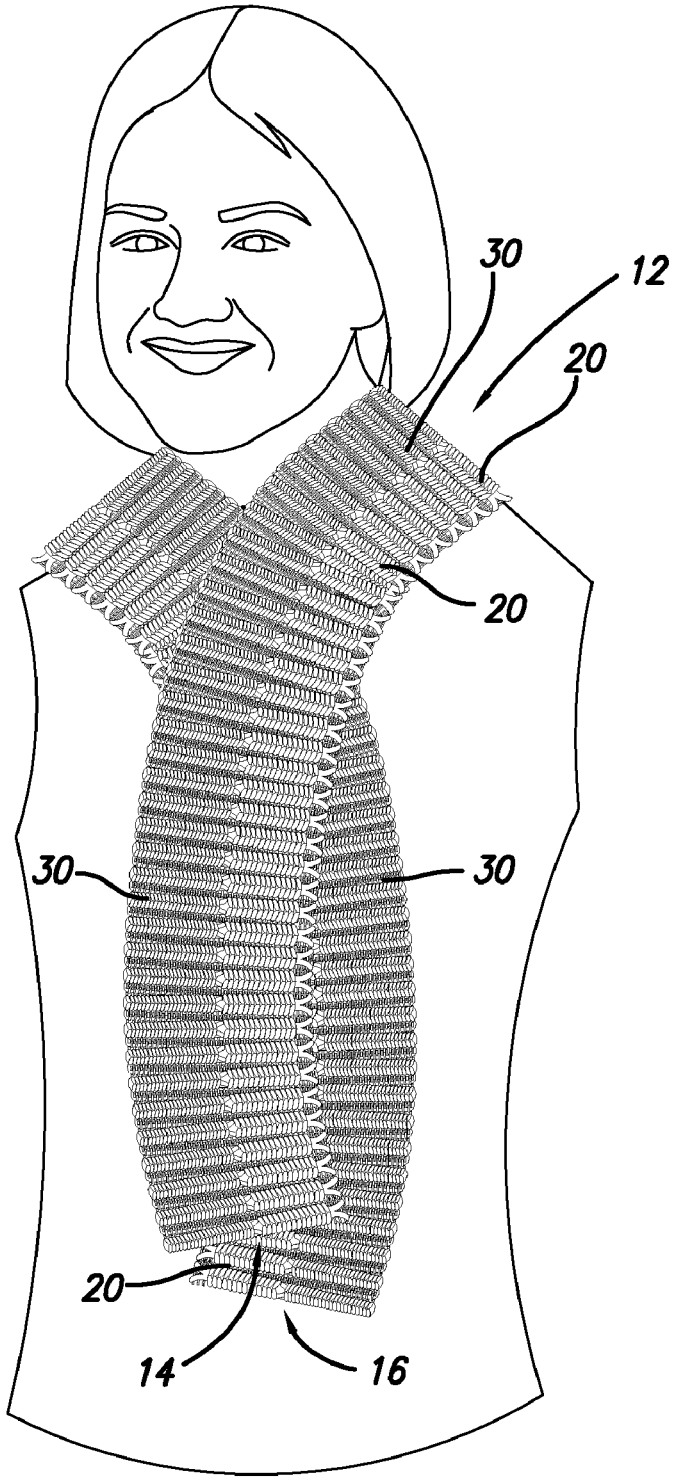
FIG. 4 is an illustration of a placement and structure one embodiment of the scarf takes and holds as a result of an application of one method of placing or tying the scarf around the wearer.

FIG. 4 is an illustration of a method by which one embodiment of the scarf may be placed or tied around the wearer. As shown in FIG. 4, scarf 10 is draped around a wearer in a crossed manner. FIG. 4 shows scarf 10 with the middle section 12 around the neck of the wearer and the two end sections 14 and 16 in front of the wearer. The outer edge 30 is on top around the neck, but because of the crossing of the two end sections 14 and 16 in the front of the wearer, outer edge 30 is also on the outside at the two end sections 14 and 16. The inner edge 20 is the on bottom around the neck and on the inside at the two end sections 14 and 16. Because of the natural hyperbolic shape of scarf 10, even though the two end sections 14 and 16 are crossed, at the very tips of the two end sections 14 and 16 the scarf re-crosses so that scarf 10 has a unique zig-zag appearance.

Figure 5:
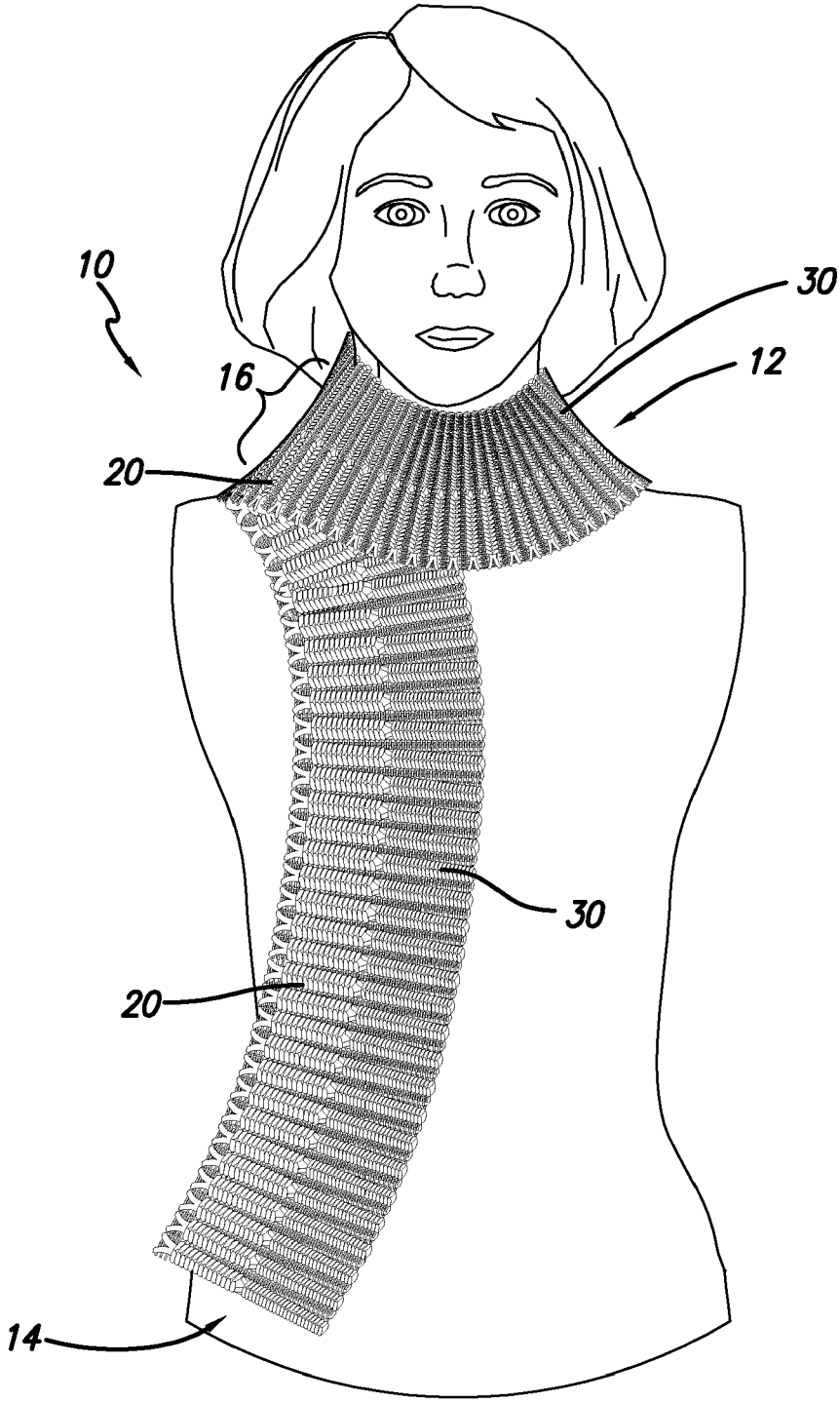
FIG. 5 is an illustration of a placement and structure one embodiment of the scarf takes and holds as a result of an application of one method of placing or tying the scarf around the wearer.

FIG. 5 is an illustration of a method by which one embodiment of the scarf may be placed or tied around the wearer. As shown in FIG. 5, scarf 10 is draped around a wearer in a one end tossed over the shoulder manner. FIG. 5 shows scarf 10 with the middle section 12 around the neck of the wearer and end section 14 in front of the wearer. End section 16 is wrapped around the front of the neck of the wear and tossed over the shoulder so that end section 16 hangs down the back of the wearer. The outer edge 30 is on top around the neck, on the outside in front of the wearer, and on the inside in back of the wearer. The inner edge 20 is the on bottom around the neck, on the inside (at end section 14) in front of the wearer, and on the outside (at end section 16) in back of the wearer.

Figure 6:
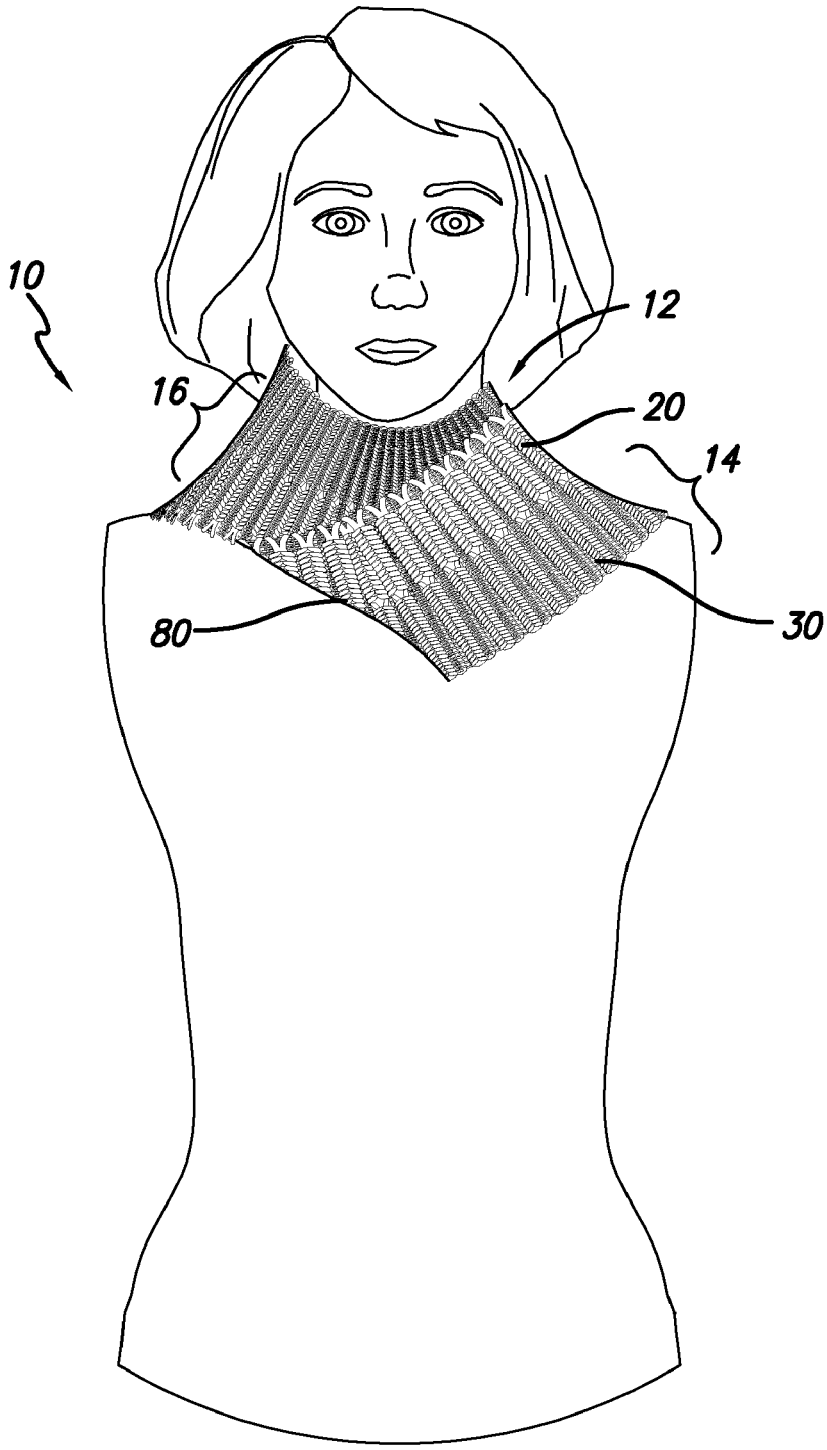
FIG. 6 is an illustration of a placement and structure one embodiment of the scarf takes and holds as a result of an application of one method of placing or tying the scarf around the wearer.

FIG. 6 is an illustration of a method by which one embodiment of the scarf may be placed or tied around the wearer. As shown in FIG. 6, scarf 10 is draped around a wearer in a toss two manner. FIG. 6 shows scarf 10 with the middle section 12 around the neck of the wearer and the two end sections 14 and 16 in back of the wearer. The outer edge 30 is on top around the neck, and because of the crossing of the two end sections 14 and 16 as they wrap around the front of the neck of the wearer, outer edge 30 is on the inside at end section 16 and on the outside at end section 14, relative to the back of the wearer. Outer edge 30 is on the outside at end section 14 because end section 14 is folded at fold 80 so that it fits in a snug manner around and over end section 16 before it is draped over the back of the wearer. If end section 14 is not folded, and is instead merely wrapped around the front of the neck of the wearer, outer edge 30 will be on the inside as end section 14 hangs down the back of the wearer.

As FIGS. 3 to 6 demonstrate, there are numerous methods that can be used to wear scarf 10 so that the scarf takes and holds an interesting and stylish architectural structure around the neck of the wearer. These numerous methods include, but are not limited to: multiple crossings of the two end sections; tying the end sections in simple knots; draping the middle section around the shoulders of the wearer, the head of the wearer, or the side of the neck of the wearer; and wrapping the scarf around the back or front of the shoulders of the wearer, rather than around the neck of the wearer. Importantly, regardless of how scarf 10 is worn by the wearer, scarf 10 takes and continues to hold the specific architectural shape designated by the wearer and consistently frames the neck, jaw, face, or other body part of the wearer in an interesting, stylish, and pleasing manner.

In summary, the present invention is a scarf with a knit tension differential between opposing sides along the length of the scarf that produces the effect of a scarf that takes and holds a specific architectural shape when it is worn by a user. The scarf of the present invention preferably has a three dimensional, hyperbolic shape that holds a form when wrapped in different ways around the wearer.

The foregoing description of the preferred embodiment of the invention has been presented for the purposes of illustration and description. While multiple embodiments are disclosed, still other embodiments of the present invention will become apparent to those skilled in the art from the above detailed description, which shows and describes illustrative embodiments of the invention. As will be realized, the invention is capable of modifications in various obvious aspects, all without departing from the spirit and scope of the present invention. Accordingly, the detailed description is to be regarded as illustrative in nature and not restrictive. Also, although not explicitly recited, one or more embodiments of the invention may be practiced in combination or conjunction with one another. Furthermore, the reference or non-reference to a particular embodiment of the invention shall not be interpreted to limit the scope the invention. It is intended that the scope of the invention not be limited by this detailed description, but by the claims and the equivalents to the claims that are appended hereto.

What is claimed is:

1. A scarf, comprising:

a hyperbolic scarf body;

wherein said hyperbolic scarf body has an inner edge and an outer edge;

wherein said inner edge and said outer edge are on opposing sides along a length of said hyperbolic scarf body;

wherein said inner edge is knitted from a narrow stitch and said outer edge is knitted from a wide stitch, and said narrow stitch and said wide stitch create a differential in a knit tension between said inner edge and said outer edge along said length of said hyperbolic scarf body;

wherein said inner edge and said outer edge meet at a transition, wherein said transition runs along said length of said hyperbolic scarf body;

wherein said differential in said knit tension causes said scarf to have a natural hyperbolic curve with said inner edge smaller than and concentrically disposed within said outer edge; and wherein said differential in said knit tension causes said scarf to take a maintain a specific architectural shape when draped around a neck of a user.

2. The scarf of claim 1, wherein said hyperbolic scarf body forms a shape of a letter C when laid out flat on a surface.

3. The scarf of claim 2, wherein said hyperbolic scarf has a middle section and two end sections;

wherein said middle section is a different color or pattern than said two end sections; and wherein said two end sections are a same color or pattern.

4. A method of tying a scarf comprising the following steps:

providing a hyperbolic scarf body with an inner edge and an outer edge, wherein said inner edge and said outer edge are on opposing sides along a length of said hyperbolic scarf body, wherein said inner edge and said outer edge have different stitching that creates a differential in a knit tension between said inner edge and said outer edge along said length of said hyperbolic scarf body, wherein said inner edge and said outer edge meet at a transition, wherein said transition runs along said length of said hyperbolic scarf body, wherein said differential in said knit tension causes said scarf to have a natural hyperbolic curve with said inner edge smaller than and concentrically disposed within said outer edge, and wherein said differential in said knit tension causes said scarf to take and maintain a specific architectural shape when draped or wrapped around the neck of wearer;

providing a hyperbolic scarf body with a middle section and two end sections; and draping said scarf around said neck of said wearer, wherein said middle section is frames a back of said neck and said two end sections rest on a plurality of shoulders of said wearer and hang in a front of a torso of said wearer, wherein said inner edge of said middle section is below said outer edge of said middle section, wherein said inner edge of said two end sections hang distally from said front of said torso of said wearer, wherein said outer edge of said two end sections are proximal to said inner edge of said two end sections, and wherein said middle section and said two end sections remain in place and maintain said structural position chosen by said wearer.

5. The method of claim 4, further comprising the step of:

crossing the two end sections such that one of the two end sections is in a front of the other of the two end sections.

6. The method of claim 5, further comprising the step of:

wrapping one of said two end sections around an opposite side of said neck of said wearer, such that said wrapped end section hangs down a back of said wearer.

7. The method of claim 6, further comprising the step of:

wrapping a second of said two end sections around said opposite side of said neck of said wearer, such that both said wrapped end sections hang down a back of said wearer.

* * * * *